US005785771A

United States Patent [19]

Mitchell, Jr. et al.

[11] Patent Number: 5,785,771

[45] Date of Patent: Jul. 28, 1998

[54] METHOD FOR MANUFACTURING PRECISION GEARS

[75] Inventors: George D. Mitchell, Jr., Oxford; Edward H. Bittner, Madison; Walter S. Koscomb, III, Sandy Hook, all of Conn.

[73] Assignee: Sikorsky Aircraft Corporation, Stratford, Conn.

[21] Appl. No.: 850,047

[22] Filed: May 2, 1997

[51] Int. Cl.[6] ..... C23C 2/28

[52] U.S. Cl. ..... 148/213; 148/214; 148/219; 148/586; 205/122; 205/135; 427/282

[58] Field of Search ..... 148/213, 214, 148/217, 219, 220, 573, 586; 205/122, 135; 427/282, 300

[56] References Cited

U.S. PATENT DOCUMENTS

| | | | |
|---|---|---|---|
| 4,154,628 | 5/1979 | Dudek et al. | 148/213 |
| 4,249,964 | 2/1981 | Bambuch et al. | 148/217 |
| 5,669,988 | 9/1997 | Takenaka et al. | 148/220 |

FOREIGN PATENT DOCUMENTS

| | | | |
|---|---|---|---|
| 60-165369 | 8/1985 | Japan | 148/214 |
| 60-258495 | 12/1985 | Japan . | |
| 62-24000 | 1/1987 | Japan . | |
| 1752828 | 8/1992 | U.S.S.R. | 148/214 |

*Primary Examiner*—George Wyszomierski
*Attorney, Agent, or Firm*—Brian A. Collins

[57] ABSTRACT

A method for manufacturing precision gears (10) including an initial step of providing a shaped workpiece ($\mathbf{30}_S$) defining a plurality of gear teeth (12) and, furthermore, defining a tooth space surface (68) defined by and between adjacent gear teeth (12). Next, a masking tool (60) is assembled in combination with the shaped workpiece ($\mathbf{30}_S$), which masking tool (60) includes a flexible back-plate (64) and plurality of compliant masking segments (62) bonded to and integrated by the flexible back-plate. Each of the compliant masking segments (62) defines a surface geometry (66) which is substantially complementary to the tooth space surface (68), and adjacent compliant masking segments (62) define an open-ended channel (70) therebetween. As assembled, the compliant masking segments (62) are forcibly urged into superposed engagement with the tooth space surfaces (68). In a subsequent step, a layer of masking material (28) is deposited on exposed surfaces of the shaped workpiece ($\mathbf{30}_S$) by an immersion process wherein the open-ended channels (70) of the masking tool (60) facilitate deposition of the masking material (28) on the top lands (14) of the gear teeth (12). The masking tool (60) is then removed from the material-masked workpiece ($\mathbf{30}_{MM}$) in preparation for a subsequent hardening step. Final steps of the method include hardening of the material-masked workpiece ($\mathbf{30}_{MM}$), and stripping of the masking material (28) from the hardened workpiece ($\mathbf{30}_H$).

7 Claims, 6 Drawing Sheets

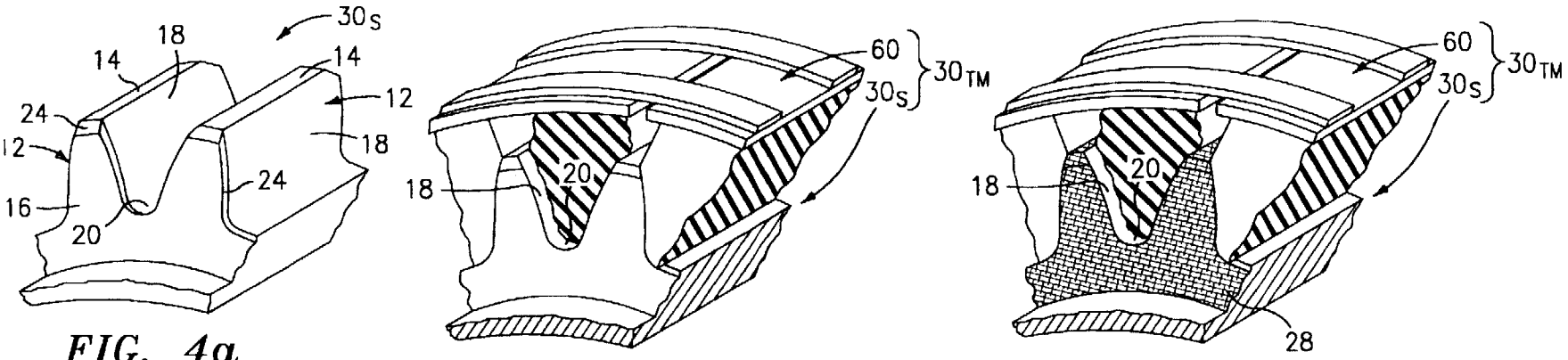
FIG. 4a
FIG. 4b
FIG. 4c
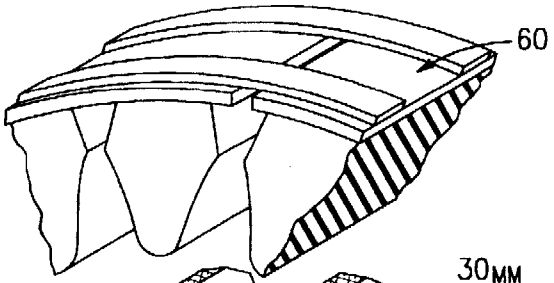
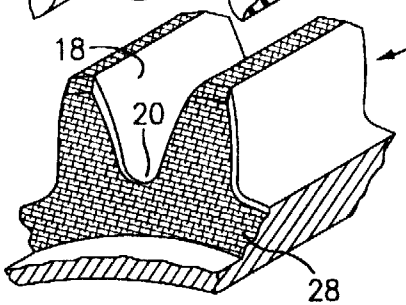
FIG. 4d
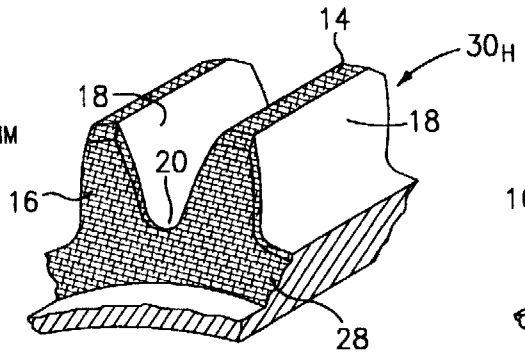
FIG. 4e
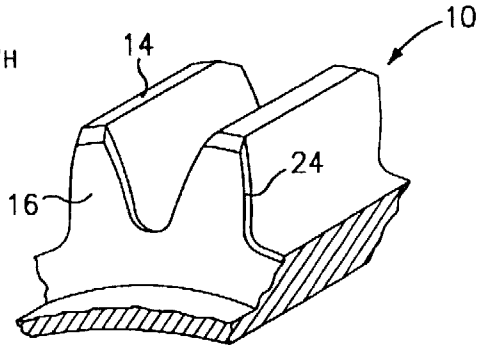
FIG. 4f

METHOD FOR MANUFACTURING PRECISION GEARS

METHODS FOR MANUFACTURING PRECISION GEARS

This invention was made with Government support Contract No. DAAJ09-91-C-A004 awarded by the Department of the Army. The Government has certain rights in this invention.

TECHNICAL FIELD

This invention is directed to a method for manufacturing precision gears and, more particularly, to a manufacturing method therefor which reduces fabrication costs, minimizes the potential for operator error, and improves the structural properties of the precision gear.

RELATED APPLICATIONS

This invention is related to a co-pending, commonly-owned, U.S. Patent application entitled "Masking Tool for Manufacturing Precision Gears and Method for Making the Same" (Docket No. S-5306).

BACKGROUND OF THE INVENTION

The manufacture of precision gears for drive trains, e.g., helicopter rotor transmissions, involves multiple highly-controlled fabrication steps which necessitate the use of highly-sophisticated manufacturing equipment, e.g., cutting apparatus, carburizing vessels, quenching equipment, etc., and highly-skilled operators to perform each fabrication step. As such, precision gears are amongst the most complex and costly articles of manufacture to fabricate. The elimination or simplification of a single process step, or a process improvement which eliminates or reduces the number of rejected or scrapped workpieces, can produce significant fiscal benefits.

FIGS. 1*a*–1*f* pictorially illustrate various stages of fabricating a precision gear utilizing conventional manufacturing techniques. For simplicity, a small segment of the precision gear is shown, i.e., a segment corresponding to two gear teeth, but it should be understood that the entire precision gear is identically-formed. FIG. 1*a* depicts a steel gear blank or forging 102 having a thin layer of copper plate 104 deposited thereon. In a prior step, the steel forging 102 has undergone a conventional copper electro-plating process wherein the copper plate 104 has been deposited to a minimum thickness of about 0.0008 inches (0.0020 cm). As will be appreciated in the subsequent discussion and views, the copper plate 104 serves to mask predefined areas of the precision gear 100 (FIG. 1*f*) from exposure to one or more subsequent carburization cycles.

In FIG. 1*b*, the gear teeth 106 are rough-machined utilizing a standard reciprocating shaper-cutter 108 which mills the profile of the gear teeth 106, e.g., the drive and coast flank involutes and the fillet radius between each gear tooth 106. Such rough machining operation mills the gear tooth profile to within about 0.010 inches (0.0254 cm) of its final dimensions.

In FIG. 1*c*, an abrasive wheel cutter 109 is employed to chamfer and deburr the edges 110 of the gear tooth profile. Such chamfering operation serves to minimize stress concentrations in the completed precision gear 100.

As a result of the prior machining operations, the copper plate 104 remains in areas corresponding to the top land 112 and end faces 114 of each gear tooth 106. Yet another consequence of the machining operations, is the inadvertent removal of copper plate, shown as void areas 116 in FIGS. 1*c* and 1*d*, due to handling prior to and during such machining operations. In FIG. 1*d*, a delicate operation is performed to "touch-up" these unplated areas 116 with a carbon stop-off paint such as produced by Park Chemical Company under the tradename "NO-CARB". Such carbon stop-off paint is functionally equivalent to the copper plate 104 inasmuch as it serves to mask these unplated areas 116 from exposure during the subsequent carburization cycle.

In FIG. 1*e*, the machined/masked workpiece 118 has undergone a conventional carburization cycle wherein atomic carbon diffuses into the exposed surfaces of the gear teeth 106, e.g., the flanks 120, fillets 122, and chamfered edges 110 thereof. More specifically, the workpiece 118 is heated to an elevated temperature (i.e., about 1650–1800 degrees F., 899–982 degrees C.) and placed in an atmosphere rich in carbon monoxide or hydrocarbon gases for a period of about 4 hours. During this process, the exposed surfaces 120, 122, 110 of the gear teeth 106 absorb atomic carbon to a depth of about 0.030 inches (0.076 cm) to about 0.060 inches (0.152 cm) while the copper plate 104 inhibits the absorption of carbon into the top lands 112 and end faces 114 of the precision gear 100. As such, the carburized areas, following a subsequent hardening step, provide a hard, wear-resistant surface while the uncarburized areas ensure that the core of the gear remains comparably soft to improve the toughness and durability of the precision gear 100.

In FIG. 1*f*, the precision gear 100 is shown in its finished form after having undergone several operations including tempering, copper stripping, heat treat/quenching, and/or final machining. The tempering operation involves heating the workpiece to an elevated temperature of about 1100 degrees F. (593 degrees C.) for a period of about 2 hours. Such tempering operation, which is performed following the carburization cycle and/or hardening operation, relieves residual stresses which develop as a result of the preceding operations. The copper stripping operation includes the step of chemically stripping the copper plate from the top lands 112 and end faces 114 of the workpiece in a cyanide bath. This operation may be viewed as an antithetical operation to the copper electro-plating process insofar as the polarity of the precision gear is reversed, i.e., is the anode in the electric circuit, to remove the copper plate. The heat treat/quenching operation includes the steps of elevating the temperature of the in-process workpiece to about 1650–1800 degrees F. and rapidly quenching the heated workpiece in a cool oil. Such heat treat/quenching transforms the steel microstructure from austenite to martinsite. Insofar as the prior carburizing cycle locally increases the carbon content along the surfaces of the flanks 120 and fillets 122 of the gear teeth 106, the heat treat/quenching operation produces an extremely hard, wear resistant shell or "case" and a comparably ductile interior core. This combination improves the fatigue properties of the precision gear 100. The final operation involves machining the workpiece to its final dimensions. This step is generally performed utilizing a Cubic Boron Nitride (CBN) cutter having a shape corresponding the tooth space profile, i.e., the profile defined by and between two adjacent teeth 106.

The prior art manufacturing method presents certain fiscal and structural disadvantages. Firstly, the touch-up operation, shown in FIG. 1*d*, is a corrective step rather than a value-added step. That is, the touch-up operation corrects for the adverse consequences of prior machining/handling operations, and, accordingly, increases cost without adding benefit.

Secondly, the touch-up operation is painstakingly laborious and requires the skills of an artisan to ensure that all unplated areas have been addressed and/or that the carbon stop-off paint has not inadvertently spilled or run-off on surfaces to be carburized. Should the operator inadvertently overlook an unplated area 116, for example, along a top land 112 of a gear tooth, a local, high concentration of carbon will be diffused into the top land 112 thereof during the carburization cycle. As such, the tip of the gear tooth becomes highly brittle following the heat treat/quenching operation and the hardened tip may result in "tooth capping" or "case-core separation". In yet another example, should the operator inadvertently deposit the carbon stop-off paint on the flank 120 of a gear tooth, a local "soft-spot" will develop along the surface. As such, the gear tooth may spaul in this area when in operation. In either event, the precision gear 100 may fail prematurely, or, depending upon the severity of the defect, may require rework or be scrapped.

Finally, the chamfered edges 110 produced by the deburring/chamfering operation, shown in FIG. 1*c*, can also be a source of tooth capping insofar as a high carbon content can develop in the corners $\mathbf{110}_c$ of the chamfered edges 110. While the deburring/chamfering operation has the adverse affect of removing copper plate from these areas, it is desirable to perform such operation prior to carburization and/or heat treat/quenching when the precision gear is relatively malleable and easily machined. While hardening of the chamfered edges 110 could be avoided with the use of a carbon stop-off paint, such operation is typically deemed fiscally disadvantageous based on the laborious nature of the touch-up operation. Furthermore, such operation produces an unacceptably high risk of error based on the probability that inadvertent spillage onto surfaces to be carburized areas is more likely to occur.

Accordingly, there is a constant search in the art for manufacturing methods and tools which eliminate or simplify fabrication steps, diminish the potential for fabrication errors, and improve the structural properties of a precision gear.

SUMMARY OF THE INVENTION

It is an object of the present invention to provide a method for manufacturing precision gears which eliminates laborious operation steps, thereby reducing processing time and manufacturing costs.

It is another object of the present invention to provide such manufacturing method which diminishes the potential for fabrication errors and, consequently, the requirement for re-work of a precision gear or rejection thereof.

It is yet another object of the present invention to provide such manufacturing method which ameliorates the structural properties a precision gear.

These and other objects are achieved by a method for manufacturing precision gears including an initial step of providing a shaped workpiece defining a plurality of gear teeth and, furthermore, defining a tooth space surface defined by and between adjacent gear teeth. Next, a masking tool is assembled in combination with the shaped workpiece, which masking tool includes a flexible back-plate and plurality of compliant masking segments bonded to and integrated by the flexible back-plate. Each of the compliant masking segments defines a surface geometry which is substantially complementary to the tooth space surface, and adjacent compliant masking segments define an open-ended channel therebetween. As assembled, the compliant masking segments of the masking tool are forcibly urged into superposed engagement with the tooth space surfaces. In a subsequent step, a layer of masking material is deposited on exposed surfaces of the shaped workpiece by an immersion process wherein the open-ended channels of the masking tool facilitate deposition of the masking material on the top lands of the gear teeth. The masking tool is then removed from the material-masked workpiece in preparation for a subsequent hardening step. Final steps of the method include hardening of the material-masked workpiece, and stripping of the masking material from the hardened workpiece.

BRIEF DESCRIPTION OF THE DRAWINGS

A more complete understanding of the present invention and the attendant features and advantages thereof may be had by reference to the following detailed description of the invention when considered in conjunction with the following drawings wherein:

FIGS. 4*a*–4*f* pictorially illustrate the various stages of manufacturing the web end spur gear of the gear shaft;

BEST MODE FOR CARRYING OUT THE INVENTION

A method for manufacturing a precision gear according to the present invention is described including a masking tool useful for practicing the method together with a method for manufacturing the masking tool. The exemplary embodiment described herein relates to manufacturing a gear shaft having dual-timed precision spur gears, however, it should be appreciated that the invention is applicable to any gear-type such as a helical, spline, bevel, spiral bevel, or face gear.

METHOD FOR MANUFACTURING A PRECISION GEAR

Figure 1A:
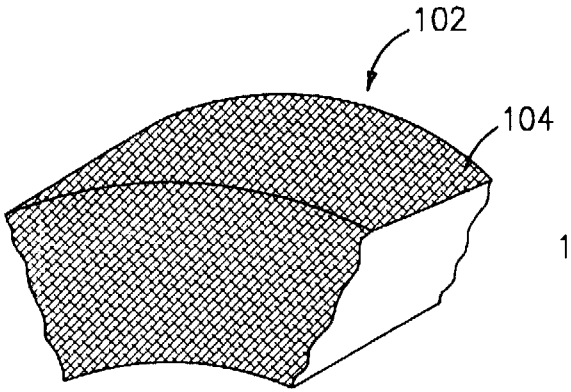
FIGS. 1*a*–1*f* depict a conventionally-fabricated precision gear at various stages of its manufacture.
Figure 1B:
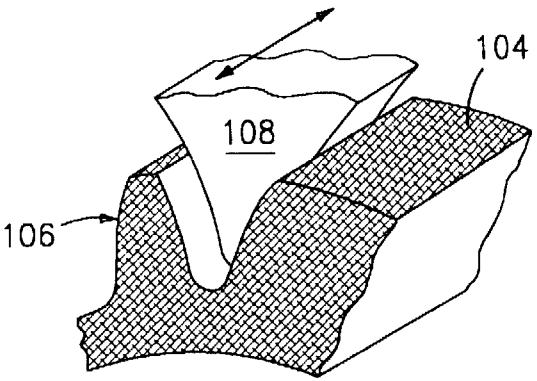
Figure 1C:
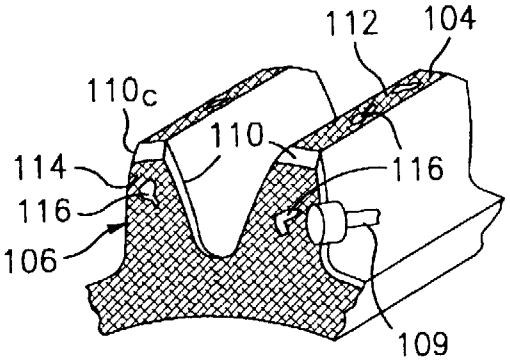
Figure 1D:
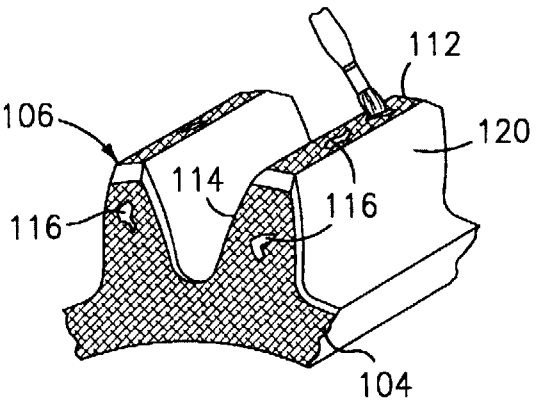
Figure 1E:
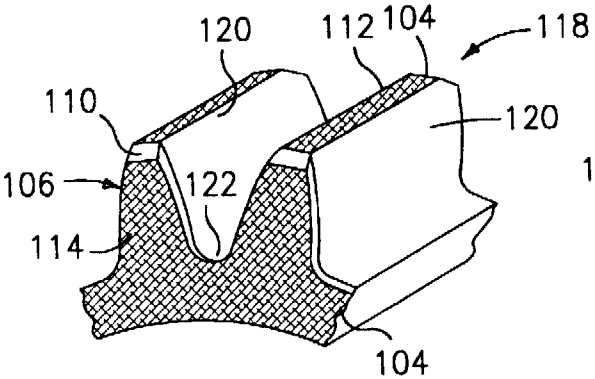
Figure 1F:
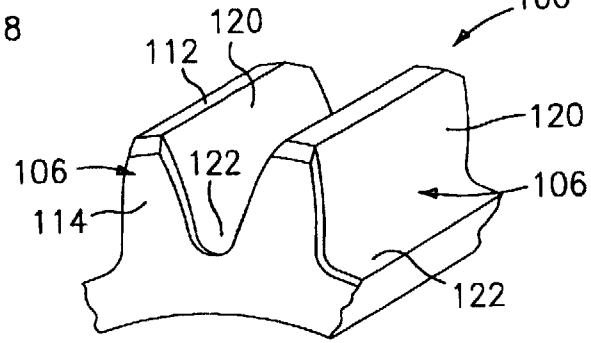
Figure 2:
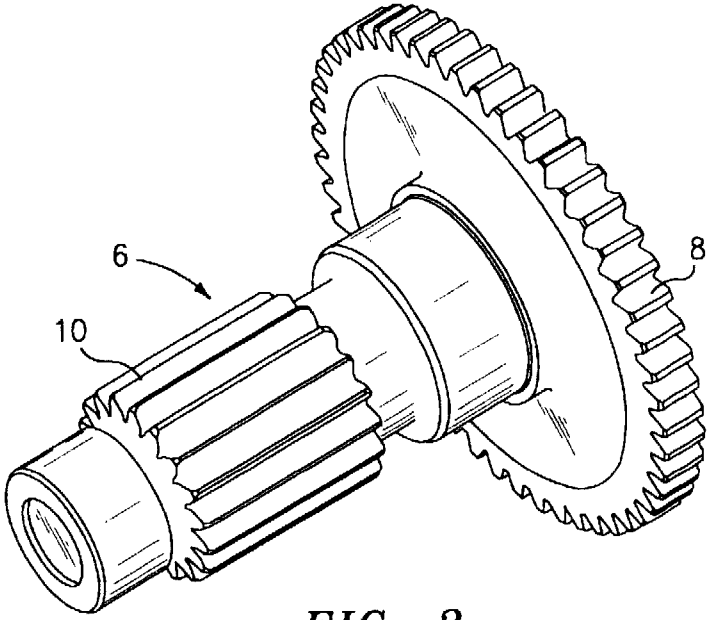
FIG. 2 depicts a gear shaft having a precision spur gears manufactured according to the teachings of the present invention.

FIG. 2 depicts a gear shaft 6 having a web end spur gear 8 and a shaft end spur gear 10 which are precisely fabricated, i.e., to within a manufacturing tolerance of about (0.0005 inches (0.00127 cm) for dual-synchronous operation. In the described embodiment, the gear shaft 6 is fabricated from a steel alloy such as 9310 steel or Pyroware™ (produced by Carpenter Steel), although, the method described herein is applicable to any metallic precision gear wherein surface hardening is a desired structural property.

Figure 3:
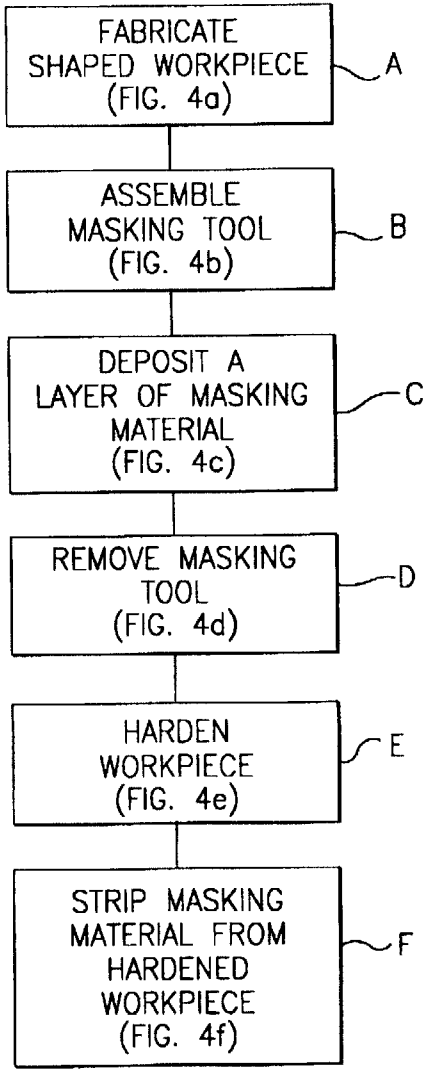
FIG. 3 depicts a flow diagram of the operational steps of the manufacturing method according to the present invention including a masking tool useful in practicing the method.

To facilitate the discussion, the manufacturing steps will be described in connection with the shaft end spur gear 10, however, it should be understood that the web end spur gear 8 may be similarly formed. In FIGS. 3 and 4a–4e, an exemplary embodiment of the manufacturing method according to the present invention is shown. FIG. 3 depicts the essential operational steps for manufacturing such precision spur gear 10 and FIGS. 4a–4e pictorially illustrate a small segment of the spur gear 10 (corresponding to two gear teeth) at various stages of its manufacture.

More specifically, in FIGS. 3 and 4a, a first step A involves fabricating a shaped workpiece $\mathbf{30}_S$ defining the three dimensional geometry of the gear teeth 12, e.g., the top land 14, end faces 16, and flanks 18 of each gear tooth 12, the fillet 20 between adjacent gear teeth 12, and any chamfered or smoothed surfaces 24 (if desired). This fabrication step A may be performed utilizing a variety of techniques, e.g., shaping, hobbing, generating, or precision casting, though, in the preferred embodiment, a steel gear blank (not shown) is machined utilizing conventional precision machining equipment. For example, a lathe (not shown) may be used to turn the outer diameter, and consequently, the top lands 14 of the gear teeth 12, a reciprocating shaper cutter (not shown) may be employed to machine the tooth space profile, e.g., the flanks 18 and fillets 20, and an abrasive wheel cutter (also not shown) may be used to deburr and form any chamfered surfaces 24. If a significant degree of gear distortion is anticipated by subsequent operational steps, the gear teeth may be rough-formed to within about (0.010 inches (0.0254 cm) of the desired final dimensions, and, subsequently, final-formed to remove inaccuracies caused by such distortion.

In FIGS. 3 and 4b, a subsequent step B includes the assembly of a masking tool 60 about the shaped workpiece $\mathbf{30}_S$. The masking tool 60, which will be discussed in greater detail hereinafter, is disposed in superposed engagement with the flanks 18 and fillets 20 of the shaped workpiece $\mathbf{30}_S$ and, functionally, serves to mask these surfaces 18, 20 from exposure during a subsequent surface deposition step. In FIGS. 3 and 4c, a next step C includes depositing a thin layer of masking material 28 to the remaining exposed surfaces of the shaped workpiece $\mathbf{30}_S$, i.e., the tops lands 12, the end faces 16 and any chamfered surfaces 24, via an immersion process. In the context used herein, an immersion process is any method which immerses the entire tool-masked workpiece $\mathbf{30}_{TM}$ in a fluidic or gaseous solution to coat or cover all such exposed surfaces 12, 16, 24. For example, the surface deposition step C may include immersing the tool-masked workpiece $\mathbf{30}_{TM}$ in a fluid bath of carbon stop-off paint which, upon removal and room temperature curing thereof, serves as the masking material 28. Yet another example includes electrolytic deposition wherein the tool-masked workpiece $\mathbf{30}_{TM}$ is immersed in a electrolytic solution for depositing a thin layer of metal plate, e.g., copper, zinc, or nickel. In the preferred embodiment, the masking material 28 is deposited by copper electro-plating wherein copper plate is deposited to a minimum thickness of about 0.0008 inches (0.0020 cm). Such masking material 28 will serve to mask such surfaces 12, 16, 24 from exposure during a subsequent hardening step.

Referring to FIGS. 3 and 4d, a next step D involves removing the masking tool 60 from the material-masked workpiece $\mathbf{30}_{MM}$ so as to expose the flank and fillet surfaces 18, 20 thereof. Furthermore, the material-masked workpiece $\mathbf{30}_{MM}$ may be cleaned in preparation for a subsequent hardening step E. In FIGS. 3, 4d and 4e, the hardening step E comprises any one of a variety of conventional hardening techniques, e.g., carburizing, nitriding, etc., which produce a surface-hardened casing or shell and a comparably ductile interior core. In the described embodiment, such surface-hardening is produced only in those areas corresponding to the exposed flank and fillet surfaces 18, 20 of the hardened workpiece $\mathbf{30}_H$. In the preferred embodiment, the hardening step E involves the substeps of carburizing the material-masked workpiece, and heat treat/quenching the carburized workpiece (these intermediate steps are not shown in FIGS. 3, 4d and 4e). More specifically, the material-masked workpiece is placed in a carburizing vessel wherein, at elevated temperatures of about 1700 degrees F., the workpiece is exposed to a carbon-rich atmosphere for a period of about four (4) hours. During the carburization cycle, atomic carbon is diffused into the exposed surfaces 18, 20 of the material-masked workpiece to a depth of about 0.030 inches (0.076 cm) to about 0.060 inches (0.152 cm). Furthermore, the masking material 28 inhibits the absorption of carbon into the top lands 14 and end faces 16 of the precision gear 10. The heat treat/quenching operation comprises the substeps of elevating the temperature of the workpiece to about 1650–1800 degrees F. and rapidly quenching the heated workpiece in a cool oil. Such heat treat/quenching operation transforms the steel microstructure from a soft austenite to a hard martinsite.

In FIGS. 3, 4e and 4f, a final step E includes stripping the masking material 28 from the hardened workpiece $\mathbf{30}_H$ to form the finished precision gear 10. Such stripping step E may be performed using any one of a variety of stripping methods, though, in the preferred embodiment a reverse-electroplate operation is performed to remove the copper plate. Such operation typically involves reversing the polarity of the workpiece $\mathbf{30}_H$, i.e., positively charging the workpiece $\mathbf{30}_H$, so as to drive the copper plate therefrom.

In addition to the above described steps A–F, it will be appreciated that other conventional processing steps may be required to achieve the desired geometry and/or structural properties of the precision gear 10. For example, it may be desirable to temper the in-process workpiece several times during the manufacturing process to relieve residual stresses therein which may result from a prior step, e.g., carburizing or hardening. Furthermore, as mentioned above, if the shaped workpiece is rough-formed at step A, it will be necessary to finish-form, i.e., finish machine, the precision gear at a subsequent step, typically after the hardening step E. Furthermore, it may be desirable to mask the entire in-process workpiece, e.g., with copper plate, to prevent additional carbon from being absorbed during the heat treat operation. With respect thereto, it will be appreciated that a heat treat furnace may produce carbonaceous fumes which could be absorbed by the carburized workpiece if not suitably masked. Moreover, while the steps A through D discussed above must necessarily be performed in the order described, steps E, F and the substeps thereof may be performed in other sequences. For example, the stripping step F may be performed prior to a heat treat/quenching substep.

MASKING TOOL AND ASSEMBLY THEREOF

FIGS. 5a–5e depict the assembly of the masking tool 60 about the web end spur gear of the gear shaft, which, at this juncture in the manufacturing process, is the shaped-workpiece $\mathbf{30}_S$. More specifically, the masking tool assembly 90 includes at least one masking tool 60 for being disposed in combination with predefined surfaces of the shaped-workpiece $\mathbf{30}_S$ (discussed in greater detail below), and a clamping means 80 for forcibly urging the masking tool 60 in combination with the shaped-workpiece $\mathbf{30}_S$. In the described embodiment, the masking tool 60 is segmented into three (3) tool segments 60*a*, 60*b*, 60*c*, which collectively circumscribe the workpiece $30_S$. Furthermore, the clamping means 80 circumscribes all of the tool segments 60*a*, 60*b*, 60*c* to integrate the masking tool assembly 90.

The masking tool 60 includes a plurality of compliant masking segments 62 which are bonded to and integrated by means of a flexible back-plate 64. In the context used herein, "compliant" means a Shore A hardness of between about 30 to about 65. Each compliant masking segment 62 defines a surface geometry 66 (see FIG. 5*e*) which is substantially complementary to the tooth space surface geometry 68 (hereinafter referred to as the "TS surface") defined by and between adjacent gear teeth 12. In the described embodiment, such TS surface 68 is defined by the surface geometry of the opposed flanks 18 of adjacent teeth and the fillet 20 therebetween. Additionally, the masking tool 60 defines a plurality of open-ended channels 70 between adjacent compliant masking segments 62, which open-ended channels 70 correspond to the location and extend the length of the top lands 14 of the gear teeth 12.

As assembled, the clamping means 80 forcibly urges the masking tool 60, and consequently, the compliant masking segments 62 into superposed engagement with the TS surface 68. That is, the clamping means 80 effects intimate contact of the compliant masking segments 62 with the TS surface 68. In the preferred embodiment, the clamping means 80 effects a contact pressure therebetween of at least 1 lbs/in$^2$ (6940 Pa) and, more preferably, at least 3.5 lbs/in$^2$ (24290 Pa). During the surface deposition step, the masking segments 62 prevent deposition of masking material (not shown) on the TS surface 68 while the open-ended channels permit the masking material to flow over and deposit on the top lands 14 of the gear teeth 12.

In the described embodiment, the compliant masking segments 62 are fabricated from an elastomer material having Shore A Hardness of about 40. Furthermore, the flexible back-plate 64 is fabricated from a metallic material having thickness of about 0.125 inches (0.3175 cm). Moreover, in the preferred embodiment, the flexible back-plate 64 is fabricated from a conductive material which produces a stable metal oxide surface such as stainless steel. As such, the metal oxide surface inhibits adhesion of the masking material to the back-plate 64 during the deposition process.

In the preferred embodiment, the flexible back-plate 64 is conductive and, accordingly, may be charged to augment the surface deposition process. More specifically, when employing copper plate as the masking material, it may be desirable to electrically charge the flexible back-plate 64 (i.e., an anode in the electric circuit) by means of a power source PS to draw copper ions inwardly toward the longitudinal center 82 (See FIG. 5*a*) of the gear teeth 12. As such, a more even thickness/distribution of copper plate is formed along the top lands 14 of the gear teeth 12.

While the described embodiment of the masking tool assembly 90 shows three (3) tool segments 60*a*, 60*b*, 60*c*, it will be appreciated that a lesser or greater number of segments may be employed depending upon the type of precision gear, number of gear teeth and/or the diameter of the precision gear. For example, a face or bevel gear may employ a single masking tool opposing the gear teeth wherein the compliant masking segments are substantially radially oriented. For a face gear, the compliant masking segments will be substantially coplanar and, for a bevel gear, the masking segments will collectively define a frustoconical shape. Furthermore, while the described embodiment depicts the flexible back-plate as being substantially solid, it should be appreciated that the back-plate may be perforated, particularly in areas corresponding to the channels 70, to facilitate the surface deposition step. Moreover, while the described embodiment depicts a single strap clamp 80 for integrating the tool segments 60*a*, 60*b*, 60*c*, it will be appreciated that multiple clamping devices may be used, i.e., one or more per tool segment, to retain and engage the tool segments. Using one of the above-described examples, the face gear may be retained and positioned via several C-clamps disposed about the periphery.

METHOD FOR MANUFACTURING THE MASKING TOOL

Figure 5A:
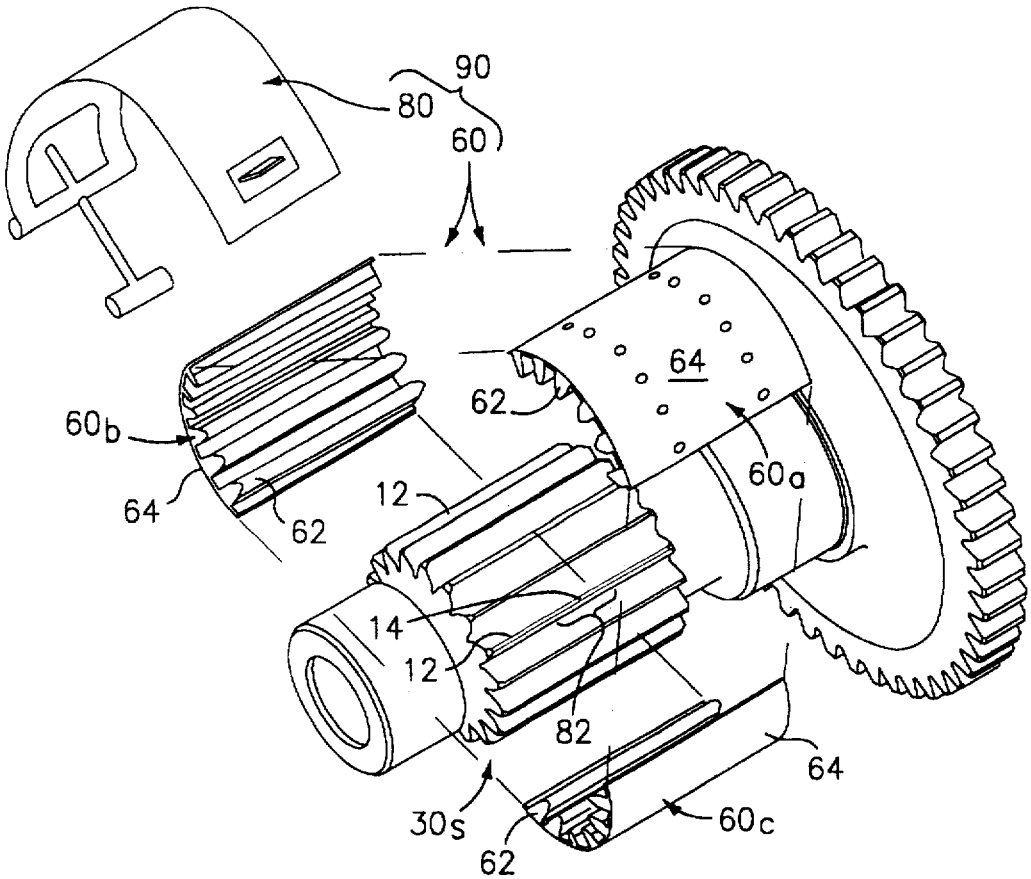
FIGS. 5*a*–5*c* depict the assembly of the masking tool about the web end spur gear of the gear shaft.
Figure 5B:
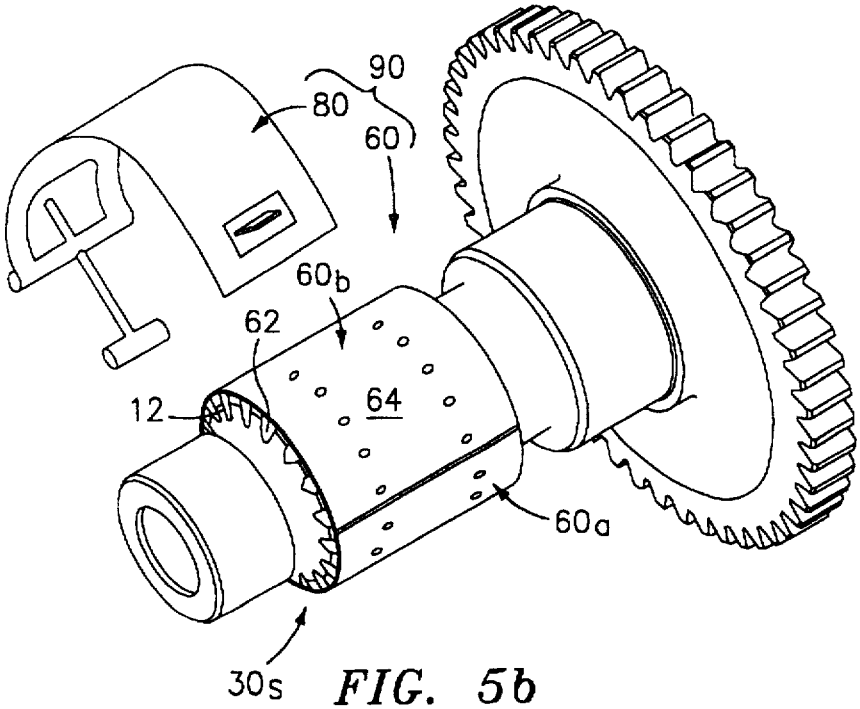
Figure 5C:
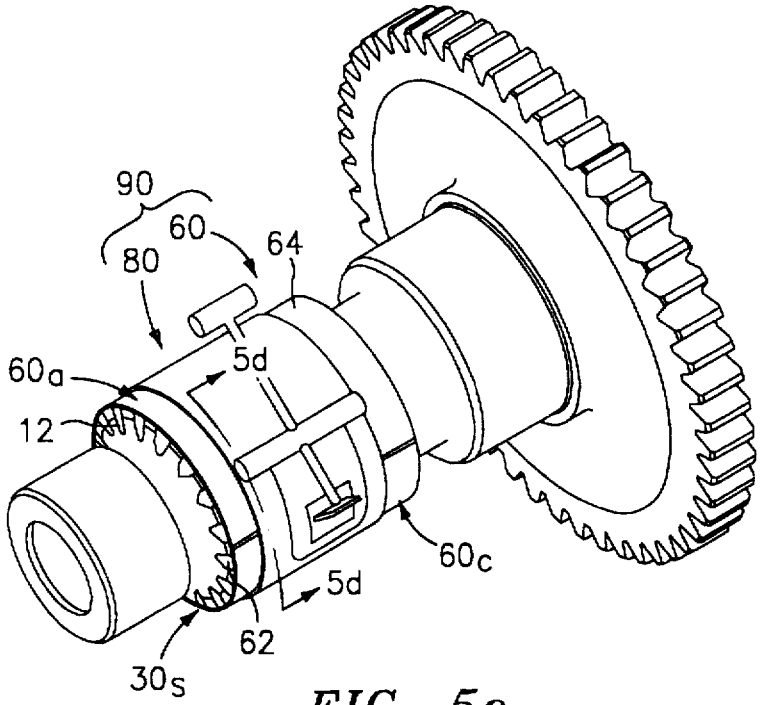
Figure 5E:
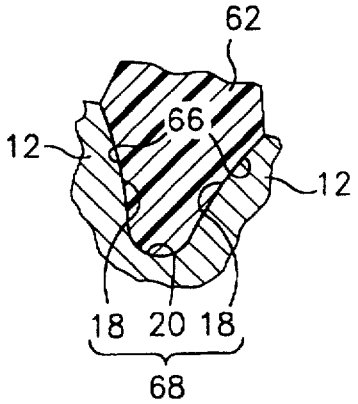
FIG. 5*e* is an enlarged view of one compliant masking segment of the masking tool.
Figure 5D:
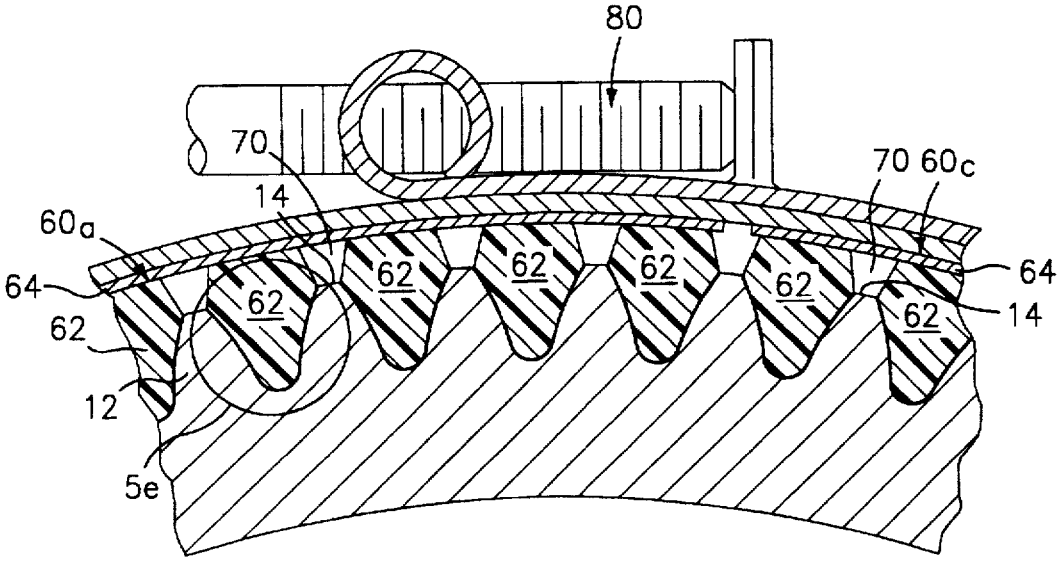
FIG. 5*d* depicts a partial section view taken substantially along line 5*d*—5*d* of FIG. 5*c* for revealing the details of the masking tool assembly, including a plurality of compliant masking segments disposed in combination with the gear teeth of the web end spur gear.

In FIGS. 5*d* and 5*e*, the masking tool 60 may be manufactured by a variety of methods which (i) produce the necessary surface geometry 66 of the compliant masking segments 62, (ii) form the open-ended channels 70 therebetween, and (iii) adhesively bond or otherwise secure the masking segments 62 to the flexible back-plate 64. For example, each compliant masking segment 62 may be machined via computer generated data or a computer-based model, and, subsequently, bonded to the flexible back-plate 64.

In the preferred embodiment, the compliant masking segments 62 are molded directly from a master model of the precision gear or an accurate representation thereof. The model will define the desired contour of the precision gear or, more precisely, the desired contour or the shaped workpiece, assuming that the shaped-workpiece may be either rough- or final-machined. In the broadest sense of this embodiment, the method comprises the steps of: forming an accurate representation of the shaped workpiece defining the TS surface 68 between adjacent gear teeth 12, preparing the surface of the flexible back-plate 64 so as to promote adhesion (e.g., abrasive blast), situating the flexible back-plate 64 proximal to the gear teeth 12, and forming compliant material between the flexible back-plate 64 and the TS surfaces 68 to produce the compliant masking segments 62 and the open-ended channels 70.

Figure 6A:
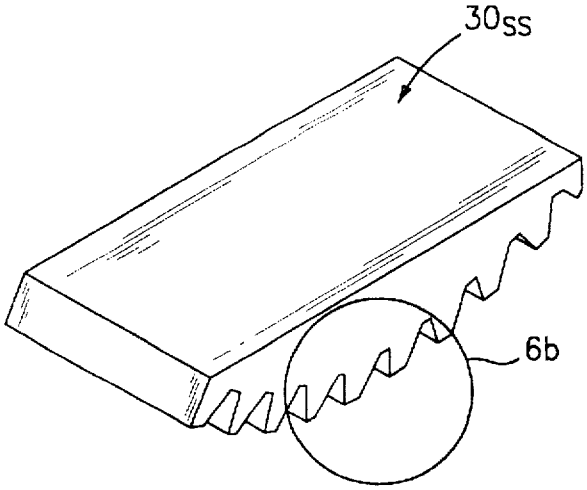
FIGS. 6*a*–6*e* pictorially illustrate an exemplary method of manufacturing the masking tool.
Figure 6B:
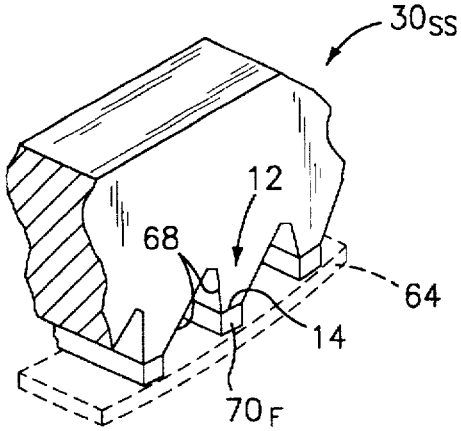
Figure 6C:
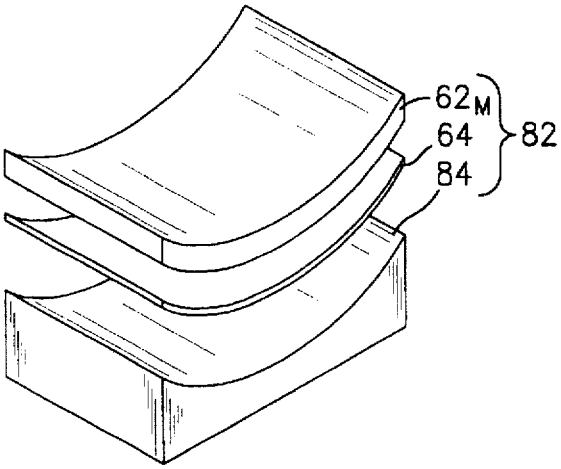
Figure 6D:
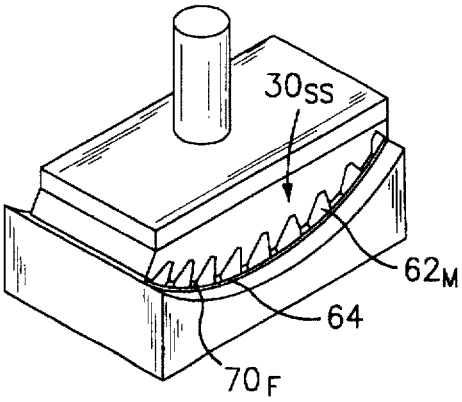
Figure 6E:
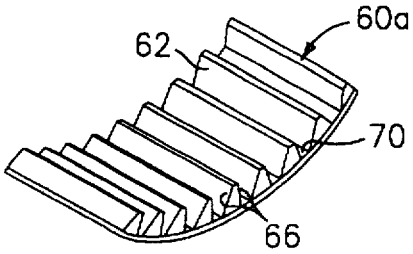

In FIGS. 6*a*–6*e*, an example of such molding method is shown. In this embodiment, and referring to FIG. 6*a*, a representative shaped workpiece has been cut into workpiece segments wherein one such segment $30_{SS}$ is shown for producing a tool segment 60*a* (FIG. 6*e*). In FIG. 6*b*, the workpiece segment $30_{SS}$ has been modified to include filler strips $70_F$ which are bonded to the top lands 14 of each gear tooth 12. The filler strips $70_F$ function to mold and define the channels 70 of the tool segment 60*a* while furthermore establishing the necessary separation distance between the flexible back-plate 64 and the workpiece segment $30_{SS}$. Furthermore, the flexible back-plate 64 has been adhesively-treated in preparation for a subsequent press molding step.

Referring to FIGS. 6*c*, a lower mold assembly 82 is assembled by stacking the flexible back-plate 64 and a sheet of compliant material $62_M$ in combination with a lower die or cradle 84. Upon set-up, and referring to FIG. 6*d*, the workpiece segment $30_{SS}$ is press molded into the sheet of compliant material $62_M$ under heat and pressure. During this step, the workpiece segment $30_{SS}$ penetrates the compliant material $62_M$ until the filler strips $70_F$ abut the flexible back-plate 64. Furthermore, the compliant material $62_M$ conforms to the shape of the workpiece segment $30_{SS}$ and bonds to the flexible back-plate 64. After cooling, the press-molded tool segment 60*a* is trimmed to remove excess compliant material $62_M$.

By using a master model of the precision gear or accurate representation thereof, the molding method ensures that the surface geometry 66 of each compliant segment 62 is complementary to the TS surface 68 (FIG. 6*b*) and will repeatably establish the necessary sealing/masking from one precision gear to the next.

SUMMARY

The precision gear manufacturing method described above and the masking tool 60 for use therein eliminates laborious operational steps, simplifies fabrication steps to reduce the potential for fabrication errors and improves the structural properties of the precision gear. Firstly, the method and masking tool 60 permit shaping of the workpiece prior to surface deposition which operational sequence minimizes the required handling of the material-masked workpiece prior to hardening. Accordingly, damage to the masking material and the requirement for laborious touch-up is eliminated. Secondly, the propensity for operator error, i.e., inadvertent oversight of an unplated region or inadvertent spillage of carbon stop-off material, is negated with the elimination of the touch-up operation. Accordingly, the structural and fiscal disadvantages associated therewith are eliminated.

Finally, by permitting shaping prior to surface deposition, the chamfered edges 110 may be formed and masked prior to hardening. Accordingly, these areas are less susceptible to "tooth capping" which improves the structural properties of the completed precision gear.

Although the invention has been shown and described with respect to exemplary embodiments thereof, it should be understood by those skilled in the art that other changes, omissions and additions may be made therein and thereto, without departing from the spirit and scope of the present invention.

What is claimed is:

1. A method for manufacturing precision gears (10) comprising the steps of:

A. providing a shaped workpiece ($\mathbf{30}_S$) defining a plurality of gear teeth (12) each having a top land (14), said shaped workpiece furthermore defining a tooth space surface (68) defined by and between adjacent gear teeth (12), B. assembling a masking tool (60) in combination with said shaped workpiece ($\mathbf{30}_S$), said masking tool including a flexible back-plate (64) and plurality of compliant masking segments (62) bonded to and integrated by said flexible back-plate (64), each of said compliant masking segments (62) defining a surface geometry (66) which is substantially complementary to said tooth space surface (68) and adjacent compliant masking segments (62) defining an open-ended channel (70) therebetween, wherein said compliant masking segments are forcibly urged into superposed engagement with the tooth space surfaces (68);

C. depositing a layer of masking material (28) on exposed surfaces of said shaped workpiece ($\mathbf{30}_S$) by an immersion process wherein said open-ended channels (70) of said masking tool (60) facilitate deposition of said masking material (28) on said top lands (14) of said gear teeth (12), said surface deposition step forming a material-masked workpiece ($\mathbf{30}_{MM}$);

D. removing said masking tool (60) from said material-masked workpiece ($\mathbf{30}_{MM}$);

E. hardening said material-masked workpiece ($\mathbf{30}_{MM}$) thereby forming a hardened workpiece ($\mathbf{30}_H$); and F. stripping said masking material (28) from said hardened workpiece ($\mathbf{30}_H$).

2. The method according to claim 1 wherein the surface deposition step includes the substep of: electro-plating a layer of copper plate on said exposed surfaces of said shaped workpiece ($\mathbf{30}_S$).

3. The method according to claim 2 wherein said compliant masking segments (62) of said masking tool (60) comprise an elastomer material and said flexible back-plate (64) comprises a metallic material.

4. The method according to claim 3 including the step of electrically charging said flexible back-plate (64) to augment the deposition of said copper plate on the top lands (14) of said gear teeth (12).

5. The method according to claim 1 wherein the hardening step includes the substeps of:

a) carburizing said material masked workpiece ($\mathbf{30}_{MM}$) to form a carburized workpiece;

b) heat treating said carburized workpiece; and c) quenching said carburized workpiece to form said hardened workpiece($\mathbf{30}_H$).

6. The method according to claim 1 wherein said assembly step includes the step of:

clamping said masking tool (60) in combination with said shaped workpiece ($\mathbf{30}_S$) so as to effect a contact pressure between said compliant masking segments (62) and said tooth space surface (68) of greater than about 1.0 lbs/in$^2$ (6940 Pa).

7. The method according to claim 1 wherein the clamping step effects a contact pressure of greater than about 3.5 lbs/in$^2$ (24290 Pa).

* * * * *